US005174642A

United States Patent [19]

Brohard et al.

[11] Patent Number: 5,174,642

[45] Date of Patent: Dec. 29, 1992

[54] REMOTE BALLAST ASSEMBLY

[75] Inventors: Bonnie J. Brohard; John C. McCartney, both of Newark, Ohio

[73] Assignee: Hollophane Company, Inc., Newark, Ohio

[21] Appl. No.: 842,454

[22] Filed: Feb. 27, 1992

[51] Int. Cl.[5] ..... F21V 19/04

[52] U.S. Cl. ..... 362/20; 362/148; 362/150

[58] Field of Search ..... 362/148, 150, 20

[56] References Cited

U.S. PATENT DOCUMENTS

| | | | |
|---|---|---|---|
| 3,860,829 | 1/1975 | Fabbri | 307/66 |
| 4,171,535 | 10/1979 | Westermann | 362/406 |
| 4,238,815 | 12/1980 | Price | 362/218 |
| 4,361,992 | 12/1982 | Rapp | 52/28 |
| 4,368,506 | 1/1983 | Rapp | 362/147 |
| 4,407,011 | 9/1983 | Lahm | 362/150 |
| 4,419,717 | 12/1983 | Price et al. | 362/148 |
| 4,420,802 | 12/1983 | Smester et al. | 362/364 |
| 4,449,168 | 5/1984 | Ewing | 362/404 |
| 4,451,762 | 5/1984 | Forte et al. | 315/87 |
| 4,459,648 | 7/1984 | Ullman | 362/307 |
| 4,460,948 | 7/1984 | Malola | 362/396 |
| 4,498,126 | 2/1985 | Hernandez | 362/220 |
| 4,535,398 | 8/1985 | Johnson et al. | 362/404 |
| 4,709,313 | 11/1987 | Goralnik | 362/414 |
| 4,855,883 | 8/1989 | Spitz | 362/260 |
| 4,890,200 | 12/1989 | Mandy | 362/20 |
| 4,976,633 | 12/1990 | Beghelli | 439/571 |
| 5,023,765 | 6/1991 | Barton | 362/429 |
| 5,073,845 | 12/1991 | Aubrey | 362/226 |

OTHER PUBLICATIONS

Holoplane Industrial Lighting Products Digest HL/693, 20 pages, Sep. 1991.

*Primary Examiner*—Carroll B. Dority

[57] ABSTRACT

A remote ballast assembly is disclosed for suspending a lighting fixture from a drop ceiling which forms the bottom boundary of a recessed plenum. The recessed plenum or ceiling cavity is typically bounded by a plurality of spaced apart cross members which form a support grid for the drop ceiling. The remote ballast assembly comprises a housing, a junction box, a bracket, a transformer, and a relay. The housing engages the cross members which define the recessed plenum to support the housing in the recessed plenum. The junction box is affixed to the housing proximate an opening in the housing, and the bracket is affixed to the junction box. The bracket includes a hook which engages a loop bracket on the lighting fixture to thereby suspend the lighting fixture in a vertical position, regardless of the orientation of the housing. The transformer is mounted to the housing, and provides electrical power from a remote source to the primary lamp during normal operation. The relay is normally open, but closes a circuit to provide electrical power to the secondary lamp when electrical power to the primary lamp is interrupted.

10 Claims, 1 Drawing Sheet

REMOTE BALLAST ASSEMBLY

TECHNICAL FIELD

This invention relates generally to support structures for lighting fixtures, and more particularly to a remote ballast assembly for supporting suspended lighting fixtures having primary and secondary lamps.

BACKGROUND ART

Suspended lighting fixtures have well known applications in commercial, industrial and instituional buildings. Many of these fixtures provide both primary lamps which are normally illuminated and secondary lamps which provide lighting in the event power is interrupted to the primary lamp. See, for example, the industrial luminaires shown in Holophane Industrial Lighting Products Digest, HL-693. These luminaires include an integrally mounted ballast having a stand-by lighting circuit to provide incandescent light in the event power is interrupted to the primary high intensity discharge lamp. This circuit has been incorporated by applicant in these luminare designs for the last several years.

See also, U.S. Pat. No. 4,451,762 to Forte et al., which discloses a control circuit and system for providing emergency lighting from a single electrical power source. As disclosed by Forte, the circuit is used only for special circumstances where both an HID lighting fixture and an incandescent stand-by light source—either in the HID lighting fixture or in a separate adjacent fixture—are powered from the same single wiring circuit which is being fed through a battery back-up power supply system which produces a square wave output voltage. The purpose of the circuit is to detect whether the input voltage has a sinusoidal or a square wave shape. Because the HID lamp will not operate properly with a square wave input, the circuit designed to switch power from the HID fixture to the incandescent stand-by source. When external power is restored to the battery back-up power supply system, a sinusoidal voltage wave will again be supplied which will be detected by the circuit to switch power back from the incandescent stand-by source to the HID lighting fixture.

Although functional, the fixtures disclosed above have proven architecturally unattractive and thus inappropriate for many indoor applications such as offices, classrooms and retail stores. Fixture designers have thus turned their attention toward the development of luminaires which may be suspended from drop ceilings such that all but the suspended optical assemblies are hidden from view within the recessed plenums. See, for example, U.S. Pat. No. 3,860,829 to Fabbri, which discloses a fluorescent lighting fixture having an auxiliary bulb which operates as an emergency light. Similarly, U.S. Pat. No. 4,890,200 to Mandy discloses a down lighting system for elevators which includes standard and emergency lights. For aesthetic purposes, these fixtures have typically been designed for support within their corresponding recessed plenum. Thus, in drop ceiling applications, prior art fixtures have been designed for support by conventional networks of intersecting cross-members.

In applications where HID-type lamps are used as the primary lighting source, those skilled in the art have recognized a need for ballasts to provide the proper voltage and wave-shape. Typically, such ballasts have been wired directly to electrical distribution systems distant from the suspended fixture. See, however, U.S. Pat. No. 4,361,992 to Rapp which discloses a support base for carrying a ballast and an electrical junction box above a ceiling tile and for further supporting a side-mounted bracket for suspending a luminare. Significantly, however, Rapp does not make any provision for a secondary lamp or a stand-by lighting circuit.

SUMMARY OF THE INVENTION

The present invention is a novel remote ballast assembly for suspending and powering a non-ballasted HID lighting fixture from a drop ceiling which forms the bottom boundary of a recessed plenum in a commercial retail space, classroom, etc. By incorporating an emergency lighting circuit in the ballast, the user is provided stand-by lighting, heretofore provided through the use of elaborate and expensive circuitry, or in non-recessed and thus aesthetically unpleasing luminare designs.

The remote ballast assembly of the present invention comprises a housing, a junction box, a bracket, a transformer, and a relay. As set forth herein, the housing is adapted to engage the cross members which define the recessed plenum to support the housing in the recessed plenum. The junction box is affixed to the housing proximate an opening in the housing, and the bracket is affixed to the junction box. The bracket includes a hook which engages a loop bracket on the lighting fixture to thereby suspend the lighting fixture in a vertical position, regardless of the orientation of the housing. The transformer is mounted to the housing, and provides electrical power from a remote source to the primary lamp during normal operation. The relay is normally open, but closes a circuit to provide electrical power to the secondary lamp when electrical power to the primary lamp is interrupted.

Accordingly, it is an object of the present invention to provide a remote ballast assembly of the type described above which is suitable for use in recessed areas.

Another object of the present invention is to provide a remote ballast assembly of the type described above that supports the fixture which it is powering.

Another object of the present invention is to provide a remote ballast assembly of the type described above which includes the necessary circuitry to provide stand-by power to a secondary lamp in the event power is interrupted to a primary lamp.

These and other objects, features, and advantages of the present invention are readily apparent from the following detailed description of the best mode for carrying out the invention when taken in conjunction with the accompanying drawings.

BEST MODE FOR CARRYING OUT THE INVENTION

With reference to the drawings, the preferred embodiment of the present invention will be described.

Figure 1:
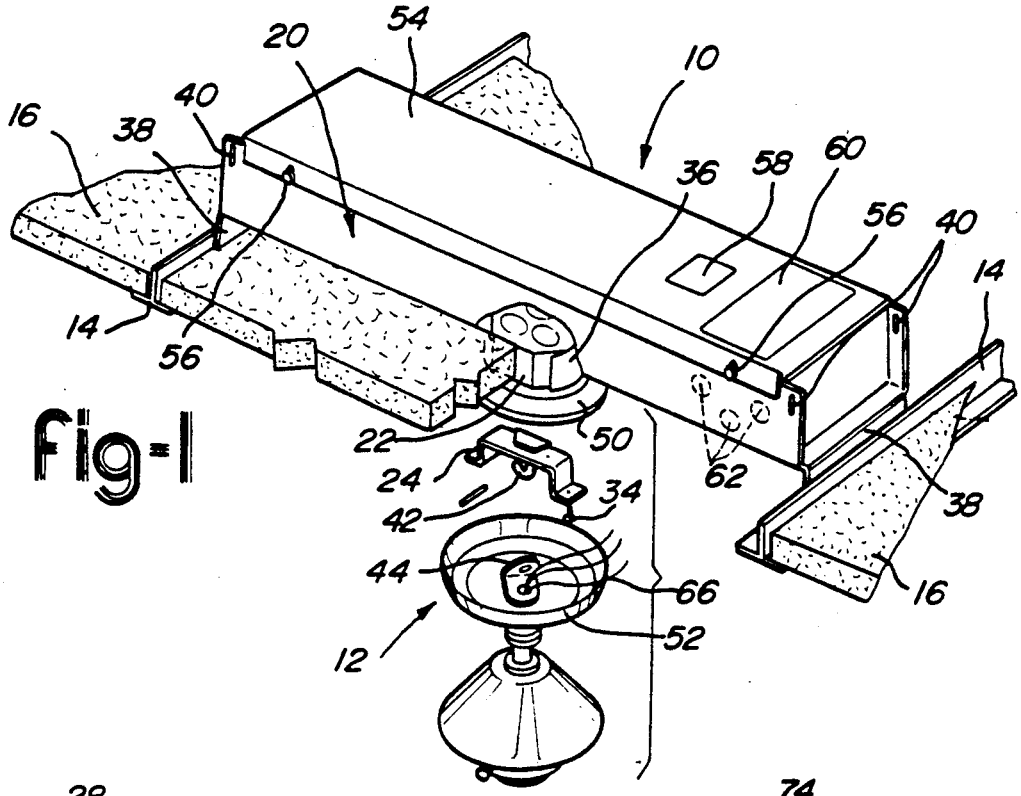
FIG. 1 is a perspective view of the remote ballast assembly of the present invention.
Figure 2:
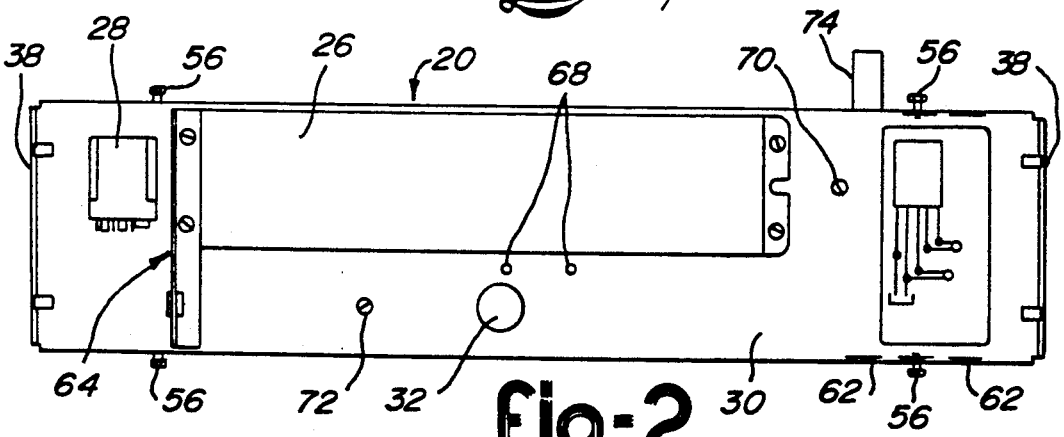
FIG. 2 is a top view of the remote ballast assembly of the present invention shown with its electrical cover removed.

FIGS. 1–2 show a remote ballast assembly generally designated by reference numeral 10 for suspending a lighting fixture 12 from a drop ceiling which forms the bottom boundary of a recessed plenum. The recessed plenum or ceiling cavity is typically bounded by a plurality of spaced apart T-shaped cross members 14 which are suspended from a permanent ceiling. Other cross members run perpendicular to the cross members 14 shown in FIG. 1 to establish a grid. Ceiling tiles 16 rest on adjacent cross members of the grid to shield the ceiling cavity from view.

Still referring to FIGS. 1-2, the lighting fixture 12 includes a primary lamp and a secondary lamp, preferably as described in copending application Ser. No. 843,894, assigned to the assignee of the present invention and filed concurrently herewith. The primary lamp is preferably a high intensity discharge (HID) lamp such as mercury, metal halide, high pressure sodium, or low pressure sodium lamp. The secondary lamp is preferably a tungsten halogen incandescent lamp which is used only in situations where power to the primary lamp is interrupted, for instance after a lightning strike in the vicinity of the building.

The remote ballast assembly 10 comprises a housing 20, a junction or outlet box 22, a bracket 24, a transformer 26, and a relay 28. The housing 20 has a bottom electrical plate 30 through which at least one opening 32 is formed. The octagonally shaped junction box 22 is affixed to the electrical plate 30 of the housing 20 proximate the opening 32 by screws 68. A junction box cover 36 may also be affixed to the bottom of junction box 22 to provide electrical closure for the junction box in applications where lighting fixtures are independently mounted but powered from the remote ballast.

Extensions 38 on the opposite ends of the housing 20 engage the cross members 14 to support the housing 20 thereabove. Slots 40 formed in the housing 20 are adapted to receive support wire (not shown) therethrough to further support the assembly 10 from a fixed structure such as the ceiling trusses or beams from which the drop ceiling hangs. Mounting feet (not shown) may also be provided to affix the ballast assembly to rafters or other remote locations, such as service rooms. For example, in these applications, the lighting fixtures will be independently mounted, yet powered by the remote ballast assembly as set forth above.

The bracket 24 is affixed to the junction box 22 and to the electrical plate 30 by screws 34. The bracket 24 includes a depending hook 42 which is removably engagable with a loop bracket 44 on the lighting fixture 12 to support the lighting fixture from the junction box 22. Although the housing 20 may be mounted in an angled orientation to conform to the slope of the ceiling, the loop bracket 44 is pivotable around the hook 42 to ensure that the lighting fixture 12 is suspended in a substantially vertical position. One skilled in the art will appreciate, however, that a wire, chain, cable, or other structure can be substituted for the loop bracket 44 and still allow the lighting fixture 12 to hang straight down.

An electrical cover 54 is attached over the top of the housing 20 and secured in place by screws 56. The electrical cover 54 electrically insulates the transformer 26 and the other internal components of the remote ballast assembly 10, as well as shielding them from external view. Labels 58 and 60 can then be accommodated on the enclosure plate 54. A series of knock outs 62 are arranged in the sides of the housing 20. The knock outs 62 are perforated sections of the sheet metal which can be punched out so that conduit, for example, leads to other lamps or incoming power lines, may extend into or out of the interior wiring chamber of the housing 20.

As shown in FIG. 2, the transformer 26 and the relay 28 are mounted to the housing 20, separated by a divider plate 64 positioned within the housing. The divider plate 64 thermally isolates the relay 28 and other high temperature components from any exposed field wiring. The transformer 26 includes the conventional components of a ballast such as a capacitor. The relay 28 is preferably electromagnetic to operate as described below, but can also be a solid state device. The opening 32 is positioned slightly off center and away from the transformer 26, so that wiring 66 from the lighting fixture 12 may enter into the wiring chamber through the opening 32 without interfering with the transformer. A ground screw 70 and a safety cable screw 72 are also provided as attachment points for a lighting fixture ground wire and safety cable, respectively.

A thermal overload protector 7 is mounted to the back of the housing 20. The thermal overload protector 74 is connected in line with the incoming power, and includes a bimetal thermal switch that interrupts power to the transformer 26, and thus to the primary and secondary lamps, when a predetermined temperature is exceeded. This trip temperature is preferably about 110° C. The thermal overload protector 74 also includes a 2 watt heater which is operational even when no current is flowing to the lamps. The heater generates its own heat at about 55°-56° C. If the housing 20 is thereafter covered, for example with insulation, and heat is not being radiated sufficiently, the thermal overload protector will shut off the power supply.

Figure 3:
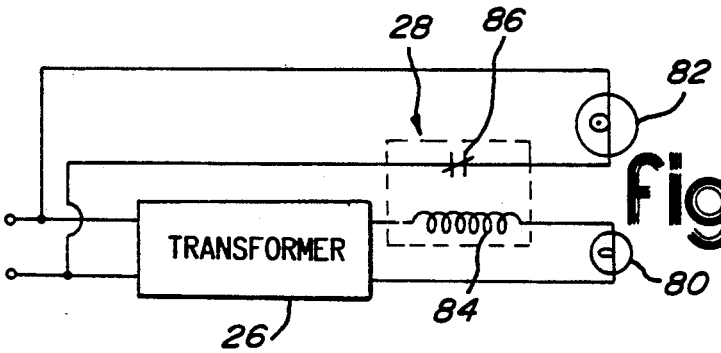
FIG. 3 is a diagrammatic view of the standby circuit used in the present invention for controlling power to the primary and secondary lamps.

Referring now to FIG. 3, there is shown a schematic diagram of the stand-by circuit used in the present invention for powering a primary lamp 80 and a secondary lamp 82. The transformer 26 and the relay 28 are in electrical communication with a remote source of electrical power such as the standard current of the building. During normal operation, electrical current enters the transformer 26, and is output to the primary lamp 80. When current flows through a coil 84 of the relay 28, a normally closed switch 86 is opened, and no power is supplied to the secondary lamp 82.

Following a momentary power outage, the arc in the HID lamp 80 will not immediately restrike when the power returns because the temperature in the arc tube is too high. Until the arc restrikes, no electrical current passes through the primary lamp 80. Therefore, the switch 86 closes, and the relay 28 switches power on from a 120 volt tap to the secondary lamp 82. When the HID lamp arc restrikes and begins to draw electrical current, the switch 86 opens again. Thus, the relay 28 alternates electrical power to the secondary lamp when electrical power to the primary lamp is interrupted. Although this circuit is preferred for use in the present invention, the secondary lamp may also be battery operated.

It should be understood that while the forms of the invention herein shown and described constitute preferred embodiments of the invention, they are not intended to illustrate all possible forms thereof. It should also be understood that the words used are words of description rather than limitation, and various changes may be made without departing from the spirit and scope of the invention disclosed.

What is claimed is:

1. A remote ballast assembly for suspending a lighting fixture having a primary and secondary lamp below a drop ceiling, the ceiling forming the bottom boundary of a recessed plenum and having a plurality of spaced apart cross members, the assembly comprising:

a housing adapted to engage at least two of the cross members to support the housing in the recessed plenum, the housing having an opening;

a junction box affixed to the housing proximate the opening;

a bracket affixed to the junction box and adapted to suspend the lighting fixture therefrom;

a transformer mounted to the housing, the transformer providing electrical power from a remote source to the primary lamp during normal operation; and relay means for providing electrical power to the secondary lamp when electrical power to the primary lamp is interrupted.

2. A remote ballast assembly as in claim 1, wherein the bracket includes a depending hook.

3. A remote ballast assembly as in claim 2, wherein the hook is removably engagable with a loop bracket on the lighting fixture, whereby the lighting fixture may be suspended in a substantially vertical position.

4. A remote ballast assembly as in claim 1, wherein the relay means comprises a relay mounted to the housing, the relay being in electrical communication with the source of electrical power and with the primary and secondary lamps.

5. A remote ballast assembly as in claim 4, further comprising a divider plate positioned within the housing for thermally isolating the relay from exposed field wiring.

6. A remote ballast assembly as in claim 4, wherein the relay is electromagnetic.

7. A remote ballast assembly as in claim 1, further comprising a thermal overload protector mounted to the housing, the thermal overload protector interrupting power to the primary and secondary lamps when a predetermined temperature is exceeded.

8. A remote ballast assembly as in claim 1, wherein the housing has a plurality of slots formed therein, the slots adapted to receive support wire therethrough to support the assembly from a fixed structure.

9. A remote ballast assembly as in claim 1, further comprising an electrical cover affixed to the housing, the electrical cover electrically insulating the internal components and shielding them from external view.

10. A remote ballast assembly for suspending a lighting fixture having a primary and secondary lamp below a drop ceiling, the ceiling forming the bottom boundary of a recessed plenum and having a plurality of spaced apart cross members, the assembly comprising:

a housing having a plurality of feet affixed to the housing, the feet engaging the cross members to support the housing thereabove, the housing having an opening and a plurality of slots formed therein, the slots adapted to receive support wire therethrough to support the assembly from a fixed structure;

a junction box affixed to the housing proximate the opening;

a bracket affixed to the junction box, the bracket including a hook removably engagable with a loop bracket of the lighting fixture, whereby the lighting fixture may be suspended in a substantially vertical position;

a transformer mounted to the housing, the transformer providing electrical power from a remote source to the primary lamp during normal operation;

an electromagnetic relay mounted to the housing and in electrical communication with the source of electrical power and with the primary and secondary lamps, the relay providing electrical power to the secondary lamp when electrical power to the primary lamp is interrupted;

a divider plate positioned within the housing, the divider plate thermally isolating the relay from exposed field wiring;

a thermal overload protector mounted to the housing, the thermal overload protector interrupting power to the primary and secondary lamps when a predetermined temperature is exceeded; and an electrical cover affixed to the housing, the electrical cover electrically insulating the internal components and shielding them from external view.

* * * * *